United States Patent [19]

Kim et al.

[11] Patent Number: 5,026,441

[45] Date of Patent: Jun. 25, 1991

[54] HIGH STRENGTHS COPPER BASE SHAPE MEMORY ALLOY AND ITS MANUFACTURING PROCESS

[75] Inventors: Young-gil Kim; Jin-woong Kim; Dong-wan Nho, all of Seoul, Rep. of Korea

[73] Assignee: Korea Advanced Institute of Science & Technology, Seoul, Rep. of Korea

[21] Appl. No.: 572,119

[22] Filed: Aug. 23, 1990

[30] Foreign Application Priority Data

Sep. 19, 1989 [KR] Rep. of Korea ..... 13418/1989

[51] Int. Cl.[5] ..... C22C 9/01

[52] U.S. Cl. ..... 148/402; 420/486

[58] Field of Search ..... 148/402; 420/486, 488

[56] References Cited

FOREIGN PATENT DOCUMENTS

| | | | |
|---|---|---|---|
| 166351 | 12/1981 | Japan | 148/402 |
| 140845 | 8/1982 | Japan | 420/486 |
| 215448 | 12/1984 | Japan | 420/486 |
| 92330 | 4/1989 | Japan . | |
| 8502865 | 7/1985 | World Int. Prop. O. | 1148/402 |

*Primary Examiner*—R. Dean

*Assistant Examiner*—George Wysromierski

[57] ABSTRACT

This invention is concerned with the development of a Cu-base shape memory alloy and it's manufacturing process. The alloy is a Cu-Al-Ni-Zr-Si shape memory alloy exhibiting high strength(830Mpa, 85kg/mml) and good ductility(7.5 - 8%) due to grain size refinement by the addition of microalloying elements (Zr, Si). Also, the invented alloy has good thermal stability and is useful for temperatures of up to about 300° C.

3 Claims, 6 Drawing Sheets

HIGH STRENGTHS COPPER BASE SHAPE MEMORY ALLOY AND ITS MANUFACTURING PROCESS

BACKGROUND OF THE INVENTION

In general, shape memory alloys show the behavior described below. A permanently deformed alloy at low temperatures recovers its original shape when heated to a temperature above its transformation temperature. Shape memory alloys having this character have been used in many industrial fields, especially pipe coupling and temperature controlling elements. Ni-Ti system shape memory alloys (as in Japanese Laid-Open Patent Publication Sho. 59-150047) are well known as alloys exhibiting excellent mechanical properties, especially high strength and ductility, and thermal stability.

Among the disadvantages of using these alloys are the high cost of the alloying elements and difficulty in their manufacturing process. Other shape memory Cu-base alloys have been developed. For example a Cu-Al-Be system is the subject of the Japanese Laid-Open Patent Publication Sho. 60-75542, Cu-Zn-Al Sytem is the subject of Sho. 60-121246 and a Cu-Ni-Al system is the subject of Sho. 60-187648; but those alloys were found to exhibit mechanical properties and thermal stability of the Cu-base alloys that were inferior to those of a Ni-Ti system. A Cu-26% Zn-4% Al shape memory alloy has exhibited low strength and bad thermal stability while a Cu-14% Al-4% Ni alloy have had low ductility. It is therefore desirable to develop alloys possessing high strength and good ductility as well as excellent thermal stability and low cost.

SUMMARY OF THE INVENTION

Hence with the foregoing in mind, it is a principal object to provide a shape memory alloy and process for manufacturing the same which would avoid the drawbacks associated with the aforementioned prior art proposals.

The present invention provides for the development of a Cu-base shape memory alloy and the manufacturing process thereof in which the Cu-Al-Ni-Zr-Si shape memory alloy of the present invention exhibits high-strength, and good ductility due to grain refinement by adding microalloying elements such as Zr and Si. In addition, the alloy has good thermal stability and is useful for temperatures up to about 300° C.

DETAILED DESCRIPTION

Figure 1A:
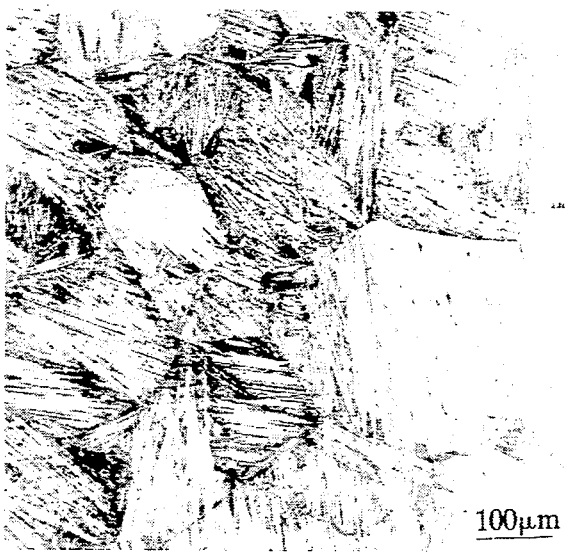
FIG. 1 shows optical micrographs of refined grain size for microalloying elements for : (a) a conventional Cu-14Al-3.8Ni alloy, (b) the invented alloy.
Figure 1B:
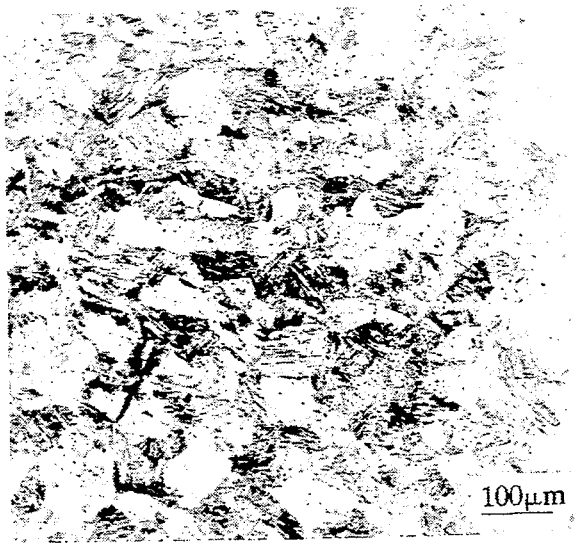

Referring to the drawings, and in particular FIGS. 1(*b*) and 2(*b*), the present invention shows an alloy having a composition consisting of Cu-13.4% Al-3.1% Ni-0.06Si-0.58Zr where the microalloying elements (Zr and Si) were added for grain size refinement. The invented alloy exhibited high strength and good ductility due to grain size refinement and also exhibited excellent thermal stability. Expensive alloying elements were eliminated or minimized. The invented alloy is thus lower in cost than other Ni-Ti alloys. The invented alloy was found also superior in mechanical properties to Cu-Zn-Al or Cu-Al-Ni system alloys.

The invented Cu-base shape memory alloy consists essentially of 10 to 15% Aluminum, 0.5 to 5.0% Nickel, 0.01 to 1.0% Silicon and 0.01 to 1.5% Zirconium by weight percent, with the remaining balance of Copper.

Aluminum addition was very effective in increasing the strength by acting as a strong solution hardener at the expense of a small decrease in ductility. Also, in order to make single phase ($\beta$) at high temperature for the shape memory effect, appropriate addition ranges were selected. Aluminum amounts of less than 10% resulted in a phase that did not show shape memory effects and amounts of Aluminum in excess of 15% resulted in a decrease in ductility. Nickel was added to improve the ductility and the solid solution hardening of the alloy. However, Nickel amounts above 5% were undesirable for cost considerations and amounts below 0.5% were insufficient for improvements in ductility.

Silicon was added for increasing strength and grain size refinement in the alloy. Silicon is well known to be a strong solid solution hardening element in copper alloys, also acting as a de-oxidizer during the melting process. Silicon amounts of more than 1% resulted in a decrease in ductility, and amounts below 0.01% were not effective in grain size refinement and ductility.

Zirconium addition was critical in this invention since the Zirconium addition greatly reduced the grain size, which was highly desirable for enhanced strength with adequate ductility for formability. Zirconium amounts above 1.5% resulted in a decrease in ductility and those below 0.01% were not effective in grain size refinement and ductility. Grain size refinement is due to the grain boundary segregation of some Zirconium.

The manufacturing process is described below. The Cu-base shape and memory alloy consisting of the balance copper having 99% purity, 10 to 15% Al, 0.5 to 5% Ni, 0.01 to 1.0% Si, 0.01 to 1.5% Zr was melted in an induction furnace under a reducing atmosphere. When the melt temperature reached 1100°-1200° C., the molten metals were poured into a mould. The cast ingots were homogenized at 750°-850° C. for 2-5 days before hot-rolling. A homogenizing treatment of less than 2 days and below 750° C. resulted in difficulty of phase transformation because the diffusion rate was decreased. A treatment of more than five days at above 850° C. increased oxidation film and grain growth. After reheating the ingots at 850°-900° C. for 1-2 hours, ingots were hot-rolled to the desired thickness by a reversible hot-roller. Rolling temperatures above 950° C. were used to induce coarse grain. All hot-rolled plates were heat treated at 850°-950° C. for 1-50 minutes followed by water-quenching to obtain refined grain size with desired martensitic structure. The alloys made by the above process exhibited high strength and good ductility, which is due to a grain size refinement by Zr and Si addition and optimized heat-treatment.

Referring to FIG. 1(*a*), there is shown an optical micrograph with the grain size refinement obtained by adding the Si and Zr for a conventional Cu-13.4% Al-3.8% Ni alloy having coarse grain size. FIG. 1(*b*) is an optical micrograph wherein Cu-13.4% Al-3.1% Ni-0.06% Si-0.58% Zr have refined grain size, also obtained by adding Si and Zr.

Figure 2A:
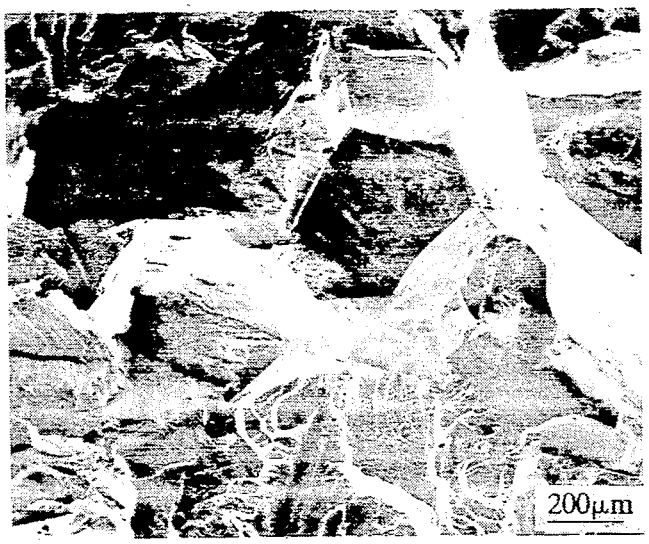
FIG. 2 shows photographs of tensile fracture surfaces for: (a) a conventional Cu-14Al-3.8Ni alloy, (b) the invented alloy.
Figure 2B:
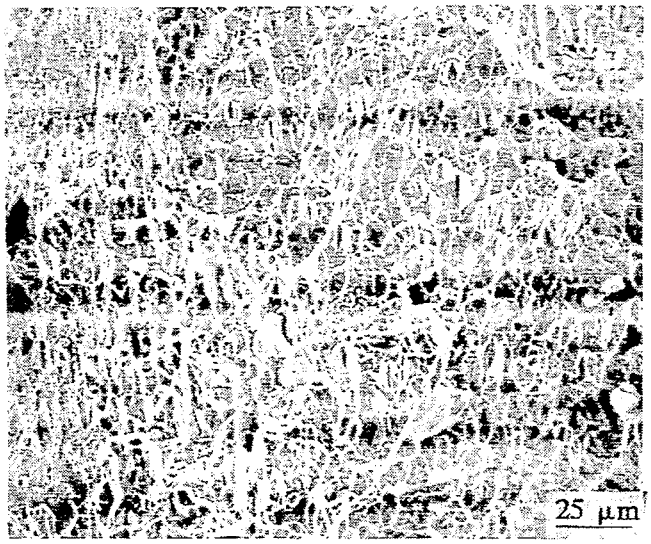
Figure 3:
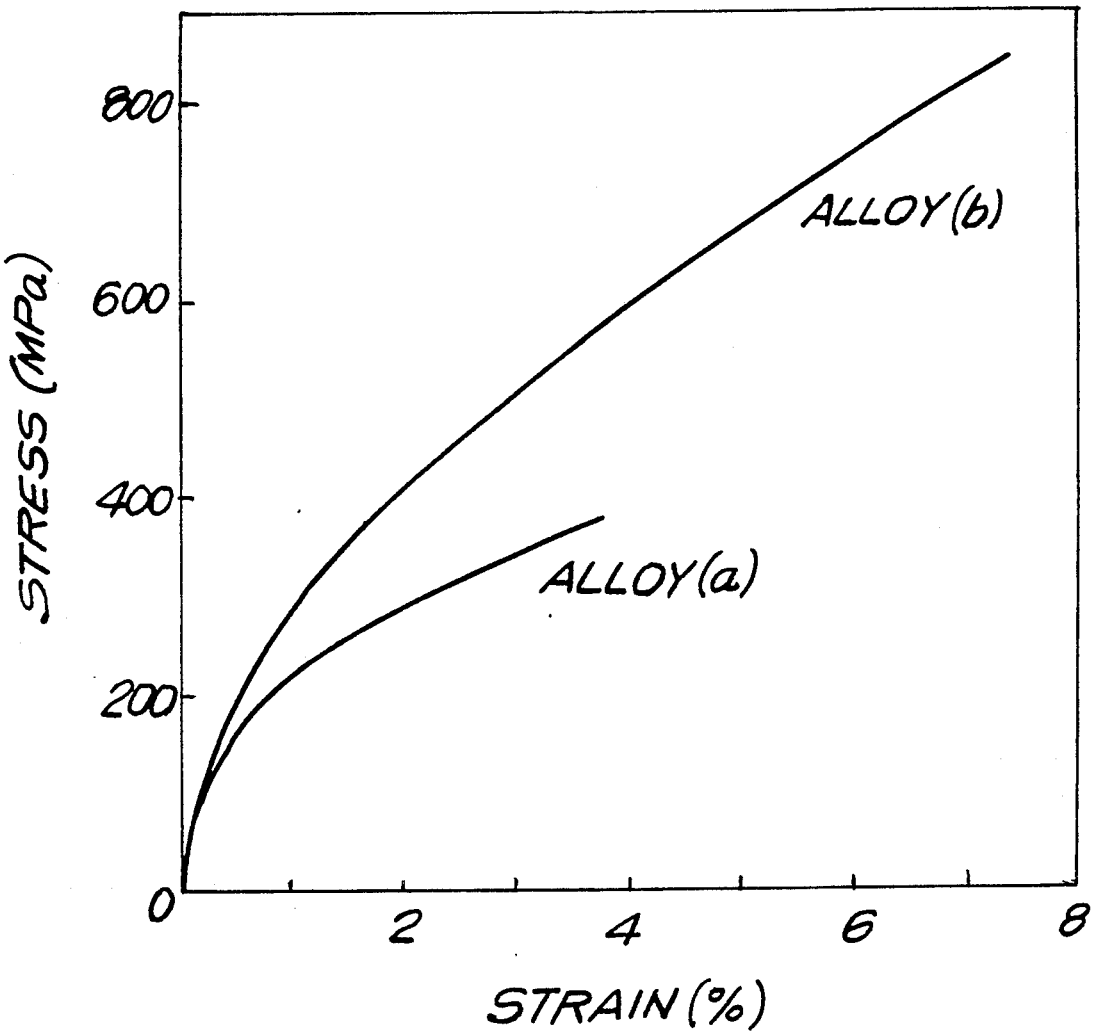
FIG. 3 shows stress-strain curves comparing the invented alloy with a conventional Cu-14Al-3.8Ni alloy for: (a) a conventional Cu-14Al-3.8Ni alloy, (b) the invented alloy.
Figure 4:
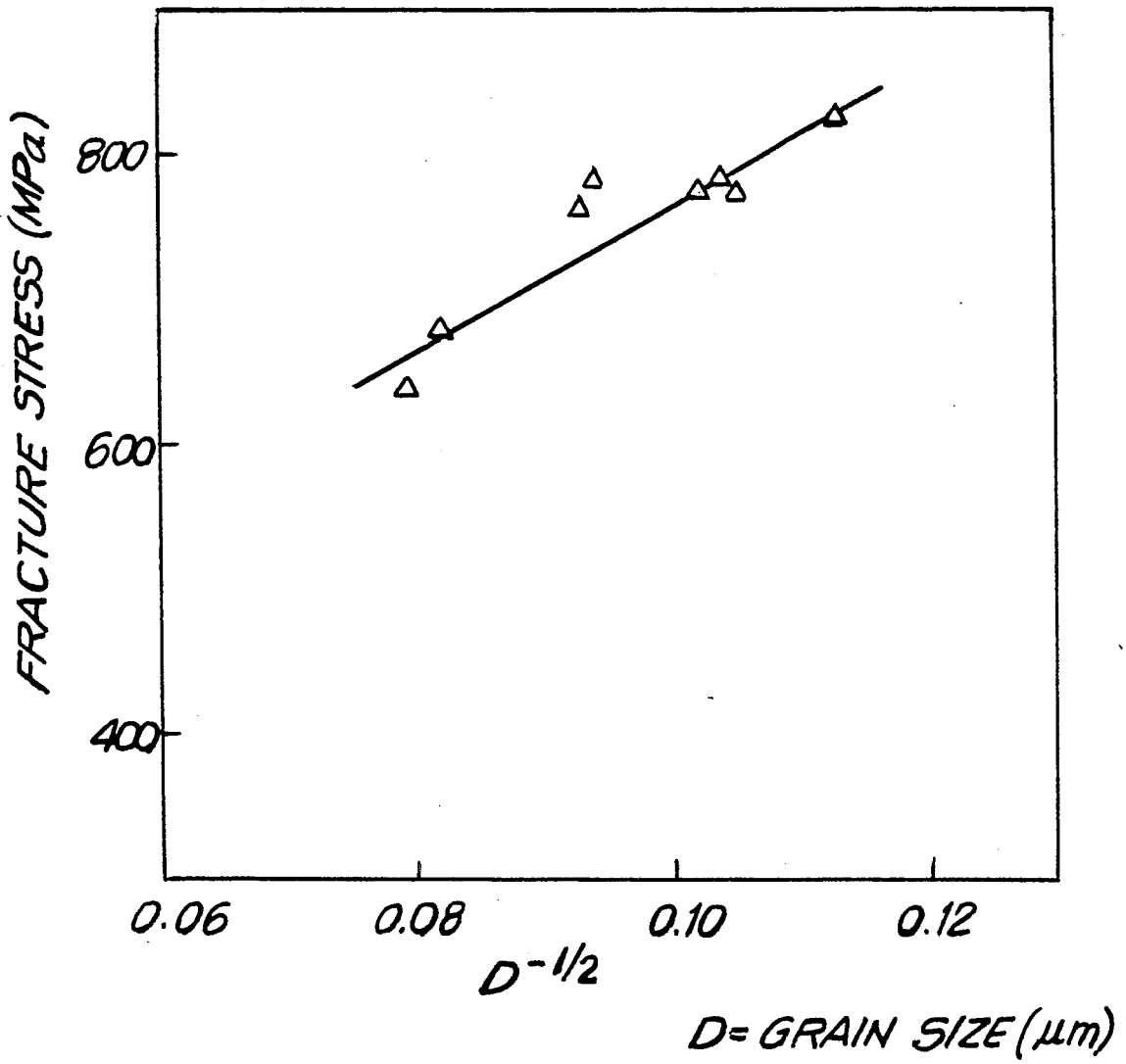
FIG. 4 shows the variation of the fracture stress $\sigma$ f, with the grain size refinement for the invented alloy.
Figure 5:
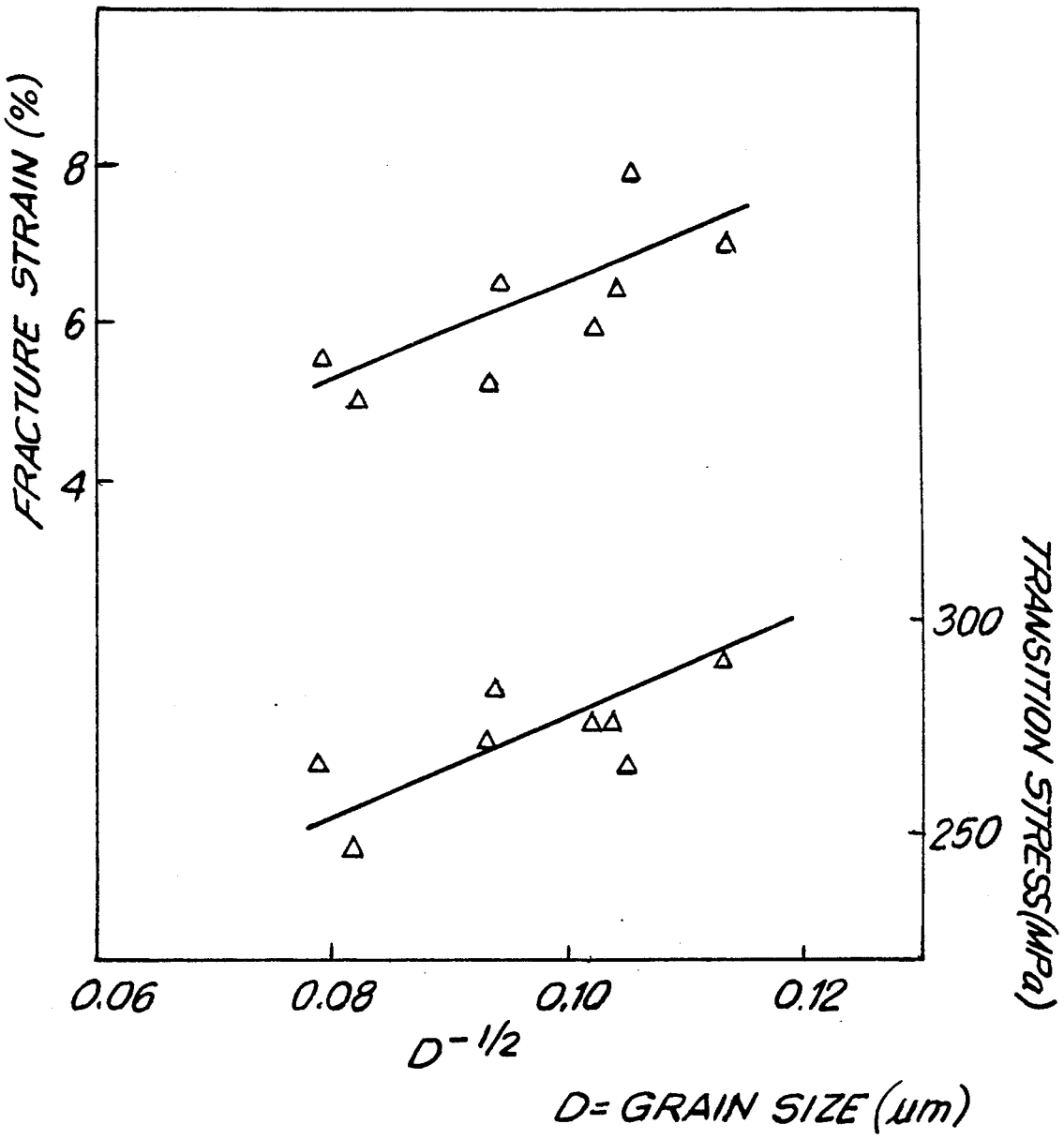
FIG. 5 shows the variation of the yield stress $\sigma$ t, and fracture strain $\epsilon$ f with the grain size refinement.
Figure 6:
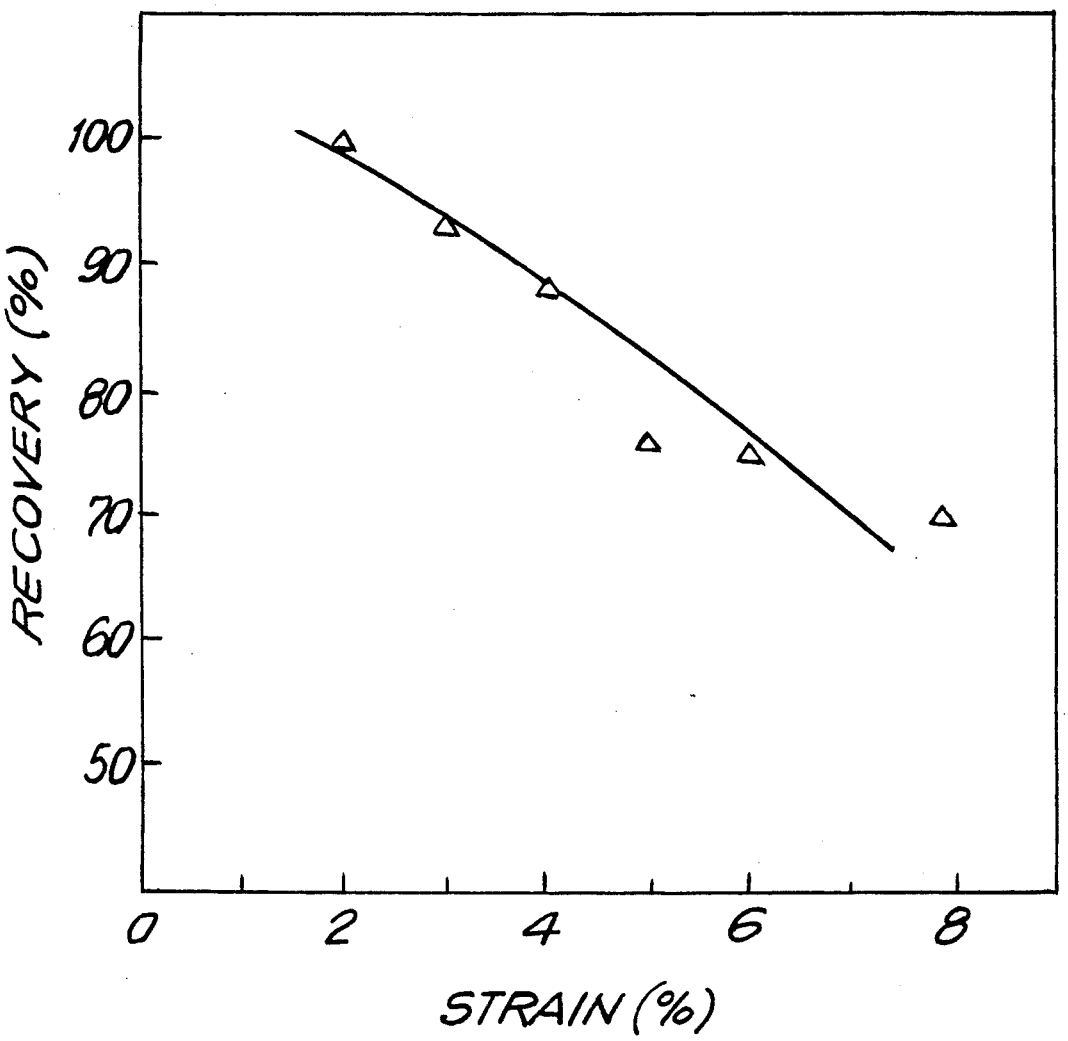
FIG. 6 shows the variation in per cent of recovery(%) with increasing tensile strain in the alloy.

FIG. 2(*a*) is a scanning electron micrograph of the tensile fracture surface showing an intergranular fracture surface for a Cu 13.4percent Al-3.8 Ni alloy. FIG. 2(*b*) is a scanning electron micrograph of the tensile fracture surface where the invented alloy shows a ductile fracture surface composed of dimples. FIG. 3 shows two tensile stress-strain curves where the fracture stress and ductility of the invented alloy when compared to that of Cu-13.4 Al-3.8% Ni is significantly higher. FIG. 4 shows an increase in the fracture stress($\sigma$ f) with decreasing grain size in the invented alloy with a maximum value of 830 Mpa(or 85 kg per mm$^2$). FIG. 5 shows the increasing yield stress($\sigma$ t) and fracture strain($\epsilon$ f) with decreasing grain size in the invented alloy with maximum values of 220 Mpa(30 kg per sq. meter) and 8%, respectively. FIG. 6 shows the variation of recovery(percentage with increasing tensile strain for the invented alloy. A complete recovery(100%) occurs at a tensile strain of 2% and also a high recovery of above (90%) occurs at 3–4% strain.

From the above explanation, it has been established that the invented shape memory alloy has excellent mechanical properties and good shape memory recovery. Some examples are explained below.

EXAMPLE 1

The invented alloy composed of composition No. 1 as shown in Table 1 was melted in an induction furnace under a reducing atmosphere, and cast into a 50×50×130 mm mould. The cast ingots were homogenized at 800° C. for 2 days and hot-rolled at 850° C. to a final thickness of 2 mm. After hot-rolling, the plates were heat treated at 850° C. for 2 minutes followed by a water-quenching. This alloy exhibits better mechanical properties than other compositions, and is easier to manufacture.

EXAMPLE 2

The invention alloy of composition No. 2 as shown in Table 1 was prepared by the same process as in the Example 1. This alloy showed less grain size refinement as compared to the alloy of Example 1 because alloy No. 2 contained less microalloying elements than the alloy of Example 1.

EXAMPLE 3

The invented alloy of compositions No. 3 as shown in Table 1 was prepared by the same process as in the Example 1. This alloy is pseudo-elastic at room temperature.

From the above results, the invented alloy containing microalloying elements Silicon and Zirconium showed higher strength and ductility when compared to the conventional shape memory alloys cited here. The above excellent properties originate from the grain size refinement that was obtained by the addition of Zr and Si. The transformation temperature(Ms) of the invented alloy is 127° C. The invented alloy has good thermal stability and is useful to about 300° C.

I do not limit myself to any particular details of construction set forth in this specification and illustrated in the accompanying drawings, as the same refers to and sets forth only certain embodiments of the invention, and it is observed that the same may be modified without departing from the spirit and scope of the invention.

TABLE 1

| | Chemical Composition (wt %) | | | | | Michanical Properties | | |
|---|---|---|---|---|---|---|---|---|
| | Cu | Al | Ni | Si | Zr | Y. S (kg/mm$^2$) | U.T.S (kg/mm$^2$) | E. L. (%) |
| Invented alloys | | | | | | | | |
| 1 | Bal. | 13.4 | 3.1 | 0.06 | 0.58 | 30 | 85 | 8 |
| 2 | Bal. | 12.0 | 2.5 | 0.02 | 0.2 | 35 | 75 | 7 |
| 3 | Bal. | 14.5 | 4.0. | 0.8 | 1.2 | 25 | 70 | 5 |
| 4 | Bal. | 12.0 | 1.3 | 0.04 | 1.5 | 34 | 75 | 6 |
| 5 | Bal. | 13.4 | 2.8 | 0.05 | 0.4 | 33 | 73 | 7 |
| Conventional alloys | | | | | | | | |
| 6 | Bal. | 13.4 | 3.8 | 3.8 | | 24 | 40 | 4 |
| 7 | Bal. | 7.9 | Be 0.5 | Zn 10.8 | | | 48 | 4 |
| 8 | Bal. | 8.1 | Be 1.0 | | | | 45 | 3 |

Having thus described the invention, what I claim as new and desire to be secured by Letters Patent is as follows:

1. A Cu-base shape memory alloy consisting essentially of: 10 to 15 percent by weight Al, 0.5 to 5.0 percent by weight Ni, 0.01 to 1.0 percent by weight Si, 0.01 to 1.5 percent by weight Zr, with the remaining balance being Cu.

2. A Cu base shape memory alloy according to Claim 1, wherein said alloy has subjected to a grain refining treatment.

3. A Cu base shape memory alloy according to Claim 1, wherein said alloy has a ductile fracture surface composed of dimples.

* * * * *